US007942135B1

(12) United States Patent
Daywalt

(10) Patent No.: US 7,942,135 B1
(45) Date of Patent: May 17, 2011

(54) VAPOR PRESSURE ENHANCER AND METHOD

(76) Inventor: Clark Lester Daywalt, Tulsa, OK (US)

( * ) Notice: Subject to any disclaimer, the term of this patent is extended or adjusted under 35 U.S.C. 154(b) by 478 days.

(21) Appl. No.: 12/206,987

(22) Filed: Sep. 9, 2008

(51) Int. Cl.
*F02M 33/00* (2006.01)

(52) U.S. Cl. ..... 123/538

(58) Field of Classification Search ..... 123/536–538
See application file for complete search history.

(56) References Cited

U.S. PATENT DOCUMENTS 4,121,543 A * 10/1978 Hicks et al. ..... 123/3
4,303,051 A * 12/1981 Weishaar ..... 123/557
4,832,837 A 5/1989 Frederick et al.
5,048,499 A 9/1991 Daywalt
5,197,446 A 3/1993 Daywalt et al.
5,881,702 A * 3/1999 Arkfeld ..... 123/538
6,450,155 B1 * 9/2002 Arkfeld ..... 123/538
7,156,081 B2 * 1/2007 Ratner et al. ..... 123/538
7,428,896 B2 * 9/2008 Eriksson et al. ..... 123/538

* cited by examiner

*Primary Examiner* — M. McMahon
(74) *Attorney, Agent, or Firm* — Molly D. McKay

(57) ABSTRACT

The present invention relates to a device that installs in-line in the fuel supply line of a gasoline, diesel, propane, or natural gas powered vehicle. The device consists of a hollow cylinder that contains a tightly packed copper wire core. The copper wire serves as a catalyst to crack the fuel's carbon chain molecules as the fuel flows through the device. The resulting fuel contains more and shorter fuel molecules, has a higher vapor pressure and burns more efficiently in the vehicle's engine.

6 Claims, 1 Drawing Sheet

VAPOR PRESSURE ENHANCER AND METHOD

BACKGROUND OF THE INVENTION

1. Field of the Invention

The present invention relates to a device that installs in the fuel line of a gasoline, diesel, propane, or natural gas powered engine of a vehicle and functions to break the carbon chains of the carbon chain fuel molecules so that the resulting shorter carbon molecules have a higher vapor pressure and burn more efficiently in the engine. The device installs in a fuel supply line and consists of a hollow cylinder that contains tightly packed copper wire through which the fuel flows prior to being burned.

2. Description of the Related Art

Applicant's U.S. Pat. Nos. 5,048,499 and 5,197,446 each teach a vapor pressure enhancer and method for treating fuel. These patents teach a cylinder with a perforated core located inside the cylinder and the core having a central bore therethrough. One of these patents teaches that the core is formed of an alloy of copper, zinc, tin and nickel, and the other patent teaches a core formed of an alloy of copper, zinc, tin, nickel, and lead. In both inventions, the fuel passes through the cylinder and contacts the metallic core prior to being burned. Contact with the metallic core breaks the carbon chains of the fuel molecules so that the resulting shorter carbon molecules have a higher vapor pressure and burn more efficiently in the engine. The shortcoming of those prior inventions is that the core does not have enough surface area to contact with the fuel and the alloy does not work as well as a catalyst for breaking the carbon chains of the fuel molecules as desired. The teaching of those two prior patents is incorporated herein by reference.

The present invention addresses these shortcomings by providing a core of tightly packed copper wire. The copper wire is preferably pure copper wire, with no added metals. The increased surface area of the tightly packed copper wire core results in better contact with the fuel as it flows through the cylinder and the copper wire does a better job of breaking the carbon molecules than the alloys previously employed. The result is that the fuel burns more efficiently and the vehicle gets better gas mileage which saves fuel and money.

SUMMARY OF THE INVENTION

The present invention is a device that installs in the fuel line of a gasoline, diesel, propane, or natural gas powered engine of a vehicle and functions to break the carbon chains of the fuel molecules so that the resulting shorter carbon molecules have a higher vapor pressure and burn more efficiently in the engine. The device consists of a hollow cylinder that contains tightly packed copper wire through which the fuel flows prior to being burned. The cylinder is provided with threaded ends at both of its ends so that it can be installed in-line in a fuel line feeding to the engine of a gasoline, diesel, propane, or natural gas powered engine of a vehicle.

DETAILED DESCRIPTION OF THE PREFERRED EMBODIMENT

Figure 1:
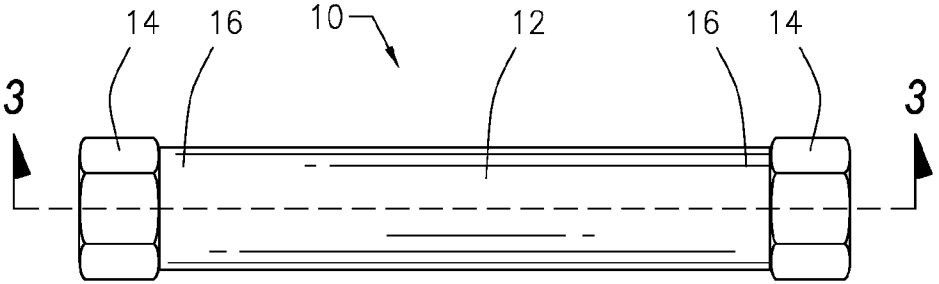
FIG. 1 is side view of a vapor pressure enhancer constructed in accordance with a preferred embodiment of the present invention as it would appear before being installed in-line in a fuel line supplying fuel to the engine of a vehicle.

Referring now to the drawings, there is illustrated a vapor pressure enhancer 10 constructed in accordance with a preferred embodiment of the present invention. FIG. 1 shows the vapor pressure enhancer 10 as it would appear before being installed in-line in a fuel line that supplies fuel to the engine of a vehicle.

Figure 2:
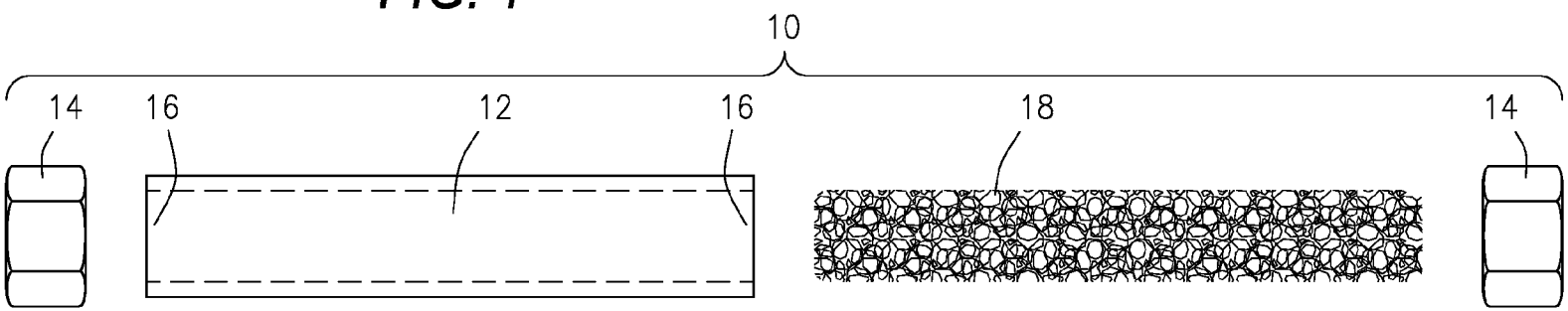
FIG. 2 is an exploded view of the vapor pressure enhancer of FIG. 1 showing the hollow cylinder, the tightly packed copper wire core that inserts into the hollow cylinder and the two threaded ends that are welded to the ends of the hollow cylinder after the copper wire core is inserted therein.
Figure 3:
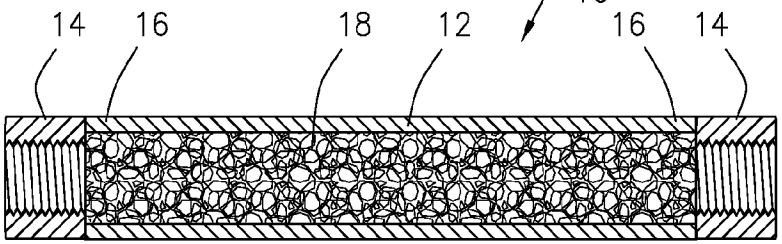
FIG. 3 is cross sectional view of the vapor pressure enhancer taken along line 3-3 of FIG. 1.

Referring also to FIGS. 2 and 3, the enhancer 10 includes a hollow tube or cylinder 12 that is provided with two female threaded ends 14 that are welded or otherwise secured to each of the two ends 16 of the hollow cylinder 12. The cylinder 12 and the female threaded ends 14 are all preferably constructed of steel. Inside the hollow cylinder 12, the enhancer 10 is provided with a tightly packed core 18 constructed of copper wire. The core 18 is held within the hollow cylinder 12 by the female threaded ends 14 which are nuts that have been welded onto the ends 16 of the hollow cylinder 12. The female threaded ends 14 serve to secure the core 18 within the hollow cylinder 12 and also serve as means for threadably securing the enhancer 10 in-line in a fuel supply line.

With the enhancer 10 installed in a fuel supply line, the fuel that flows through the fuel line must pass through the hollow cylinder 12 of the enhancer 10. The fuel contacts the tightly packed copper wire core 18 as it passes through the enhancer 10. The copper wire of the core 18 serves as a catalyst to break the longer chain molecules of the fuel into shorter molecules. The fuel pressure activates the copper catalyst to cause this catalytic cracking or breaking of the fuel molecules.

The large surface area of the copper wire core 18 causes better contact between the fuel and the catalyst, resulting in more fuel molecules being broken into shorter molecules. Breaking fuel molecules creates more total fuel molecules available for burning. This results in a fuel that has a higher vapor pressure and that burns more efficiently. More efficient burning results in more horse power, higher gas mileage, better fuel economy, lower operational costs for the vehicle, cleaner burning fuel, less exhaust emissions and less air pollution, less carbon build up and less fouling of fuel injectors and the cylinders, and lower vehicle maintenance costs.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A vapor pressure enhancer for installation in-line in a fuel line that supplies fuel to a gasoline, diesel, propane, or natural gas powered engine comprising:

a hollow cylinder provided with two female threaded ends for attaching the cylinder in-line in a fuel supply line of a gasoline, diesel, propane, or natural gas powered engine, and a core of tightly packed pure copper wire provided within the hollow cylinder which acts as a catalyst to catalytically crack molecules of fuel as fuel flows through the cylinder.

2. A vapor pressure enhancer according to claim 1 wherein said cylinder is constructed of steel.

3. A vapor pressure enhancer according to claim 2 wherein said female threaded ends are steel nuts that are welded to both ends of the cylinder.

4. A method for catalytically cracking fuel in-line in a fuel line that supplies fuel to a gasoline, diesel, propane, or natural gas powered engine comprising:

securing a hollow cylinder containing a core of tightly packed pure copper wire in-line in a fuel line that supplies fuel to a gasoline, diesel, propane, or natural gas powered engine, and passing fuel through the cylinder so that the fuel comes into contact with the copper core which serves as a catalyst to catalytically crack the molecules of the fuel thereby forming a fuel mixture containing more and shorter molecules which burn more efficiently in a gasoline, diesel, propane, or natural gas powered engine.

5. A method for catalytically cracking fuel in-line in a fuel line that supplies fuel to a gasoline, diesel, propane, or natural gas powered engine according to claim 4 further comprising:

burning the fuel mixture that exits the cylinder in a gasoline, diesel, propane, or natural gas powered engine.

6. A method of making a vapor pressure enhancer for installation in-line in a fuel line that supplies fuel to a gasoline, diesel, propane, or natural gas powered engine comprising:

inserting a core of tightly packed pure copper wire within a hollow steel cylinder, and welding steel female threaded nuts on each end of the cylinder to secure the core within the cylinder and to provide means for securing the cylinder in-line in a fuel line that supplies fuel to a gasoline, diesel, propane, or natural gas powered engine.

* * * * *